United States Patent [19]

Smith

[11] Patent Number: 4,995,758

[45] Date of Patent: Feb. 26, 1991

[54] CENTER BAR INSERTER

[75] Inventor: Don W. Smith, Edmond, Okla.

[73] Assignee: CMI Corporations, Oklahoma City, Okla.

[21] Appl. No.: 387,946

[22] Filed: Jul. 31, 1989

[51] Int. Cl.[5] ..... E01C 23/04

[52] U.S. Cl. ..... 404/88; 404/100

[58] Field of Search ..... 404/88, 100

[56] References Cited

U.S. PATENT DOCUMENTS 4,433,936 2/1984 Moser ..... 404/88

4,799,820 1/1989 Laeuppi et al. ..... 404/100

FOREIGN PATENT DOCUMENTS 247993 7/1970 U.S.S.R. ..... 404/88

*Primary Examiner*—William P. Neuder

*Attorney, Agent, or Firm*—Dunlap, Codding, Peterson & Lee

[57] ABSTRACT

A center bar inserter having a frame for supporting a plurality of forks for pivotal movement about a horizontal axis is provided. Insertion of a center bar is preformed by simultaneously extending the forks into the concrete slab while the forks pivot about a horizontal axis. A pair of vibrating sleds are secured to the float pan reward of the center bar inserter for repairing the surface of the concrete slab disturbed by the insertion of the center bar.

14 Claims, 7 Drawing Sheets

20
24
26
32
35
40
50
54
58
60
62
63
64
65
66
70
72
74
76
78
79
80
82
84
86
88
90
138
150
152
154
156
158
160
162
163
164
165
166
168
170
172
174
176
4
5

CENTER BAR INSERTER

BRIEF SUMMARY OF THE INVENTION

1. Field of the Invention

The present invention relates generally to an apparatus for inserting center bars into a freshly formed concrete slab.

2. Background of the Invention

In the present state of the art of inserting center bars into slabs of freshly formed concrete, generally, the center bar inserter is carried by a paving machine during the formation of the concrete slab. The inserter is provided with a sled slidably supported above the concrete slab by tracks. A plurality of extendable forks are mounted to the sled for inserting the bar into the slab. Such a system is represented by U.S. Pat. No. 4,799,820.

In operation, the paving machine travels over the road bed depositing the concrete slab thereon as the bars are inserted therein by extending the forks. As the forks enter the concrete slab, forces, generated by the forward motion of the paving machine, develope between the forks and the fresh concrete. In this way, the extending forks trench the surface of concrete until forces sufficient to defeat the inertial force of the sled upon the tracks are exerted against the forks. When this occurs, the sled is pulled along the tracks such that the relative horizontal position of the forks in the concrete slab remains constant. After the forks are retracted from the concrete slab, a ram repositions the sled on the tracks and the operation is repeated.

As the magnitude of the inertial force between the sled and the track varies according to track design, lubricants, and debris and deposits adhering to the sliding surfaces, the force required to defeat the inertial force of the sled varies. Additionally, as the plasticity of the concrete forming the slab varies, the distance the forks must be inserted into the slab before overcoming the inertial force of the sled varies. In either case, the forks may be pulled across the surface of the concrete slab for an extended distance before developing sufficient forces to move the sled across the tracks. As a result, significant surface disruption to concrete slab generally occurs.

The present invention eliminates these and other disadvantages by providing a bar inserter pivotally mounted to the paving machine. The inserted is pivoted forward of the axis of rotation by a ram. As the forks extend into the concrete, the ram relaxes and the inserter pivots rearward. The relative position of the forks with respect to the point of insertion is maintained by the rearward pivoting stoke of the inserter and the forward motion of the paving machine. In this way, disturbance to the concrete slab during the insertion process is significantly reduced.

BRIEF DESCRIPTION OF THE DRAWINGS

FIG. 2A is an enlarged view of a portion of FIG. 2.

FIG. 6 is a cross-sectional view taken along lines 6—6 of FIG. 3.

DETAILED DESCRIPTION OF THE DRAWINGS

Figure 1:
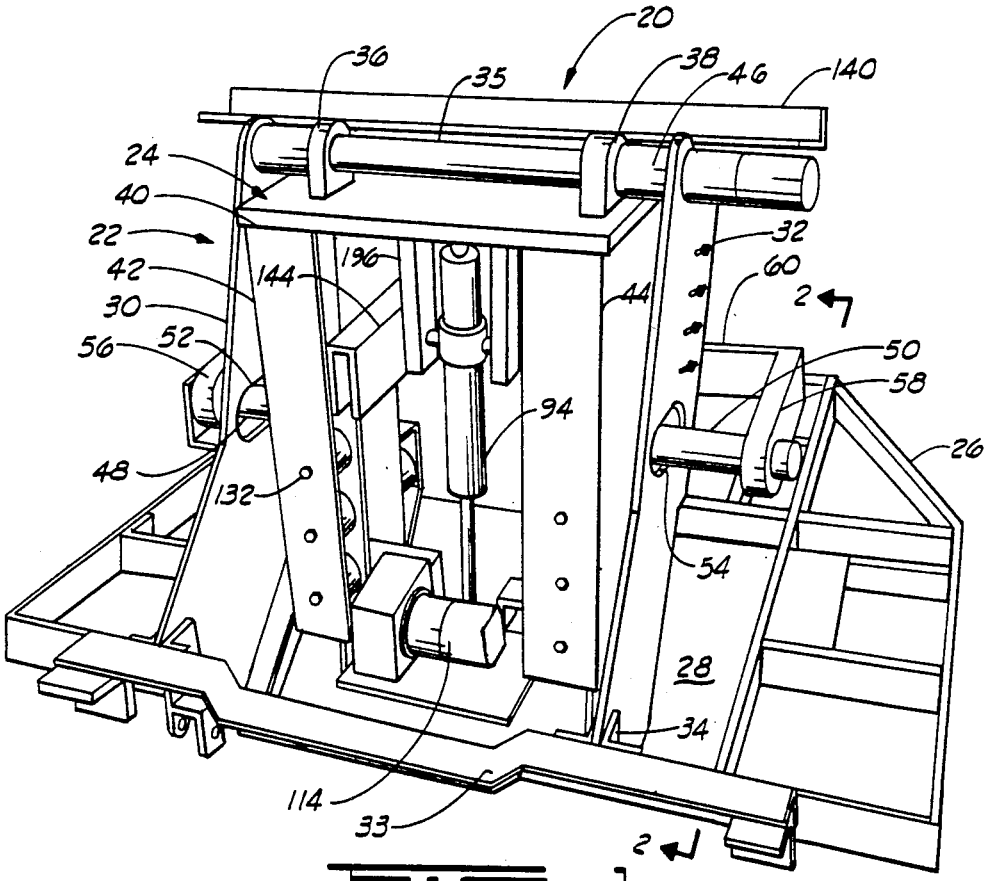
FIG. 1 is a front perspective view of the center bar inserter constructed in accordance with this invention.
Figure 3:
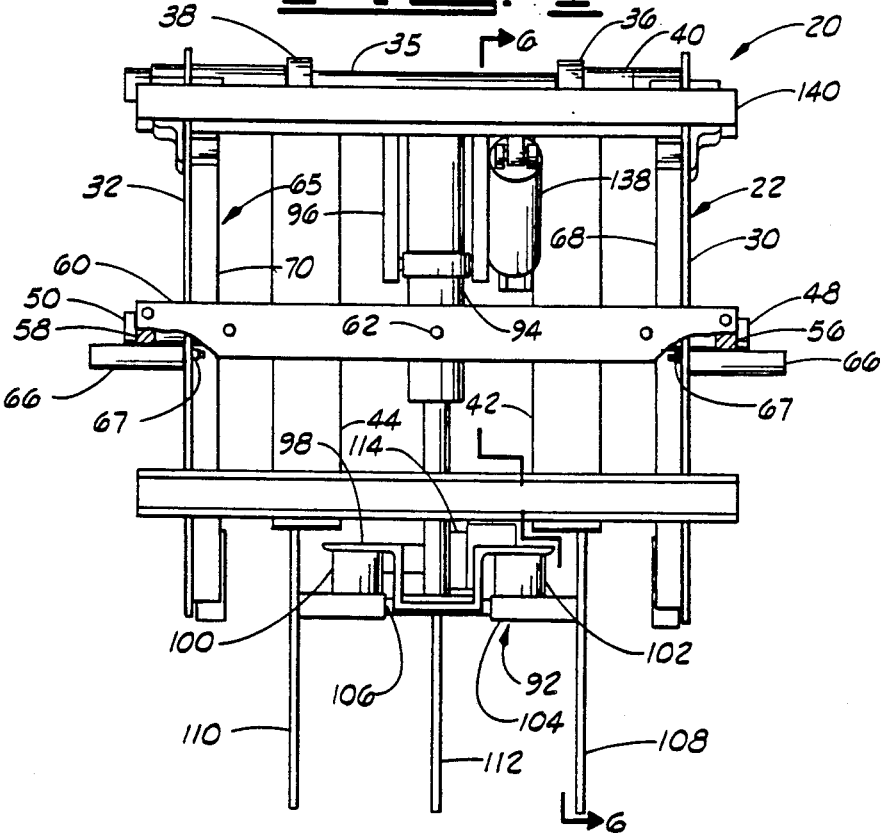
FIG. 3 is a rear elevational view of FIG. 1 with portions removed to illustrate some internal structure.
Figures 2, 3:
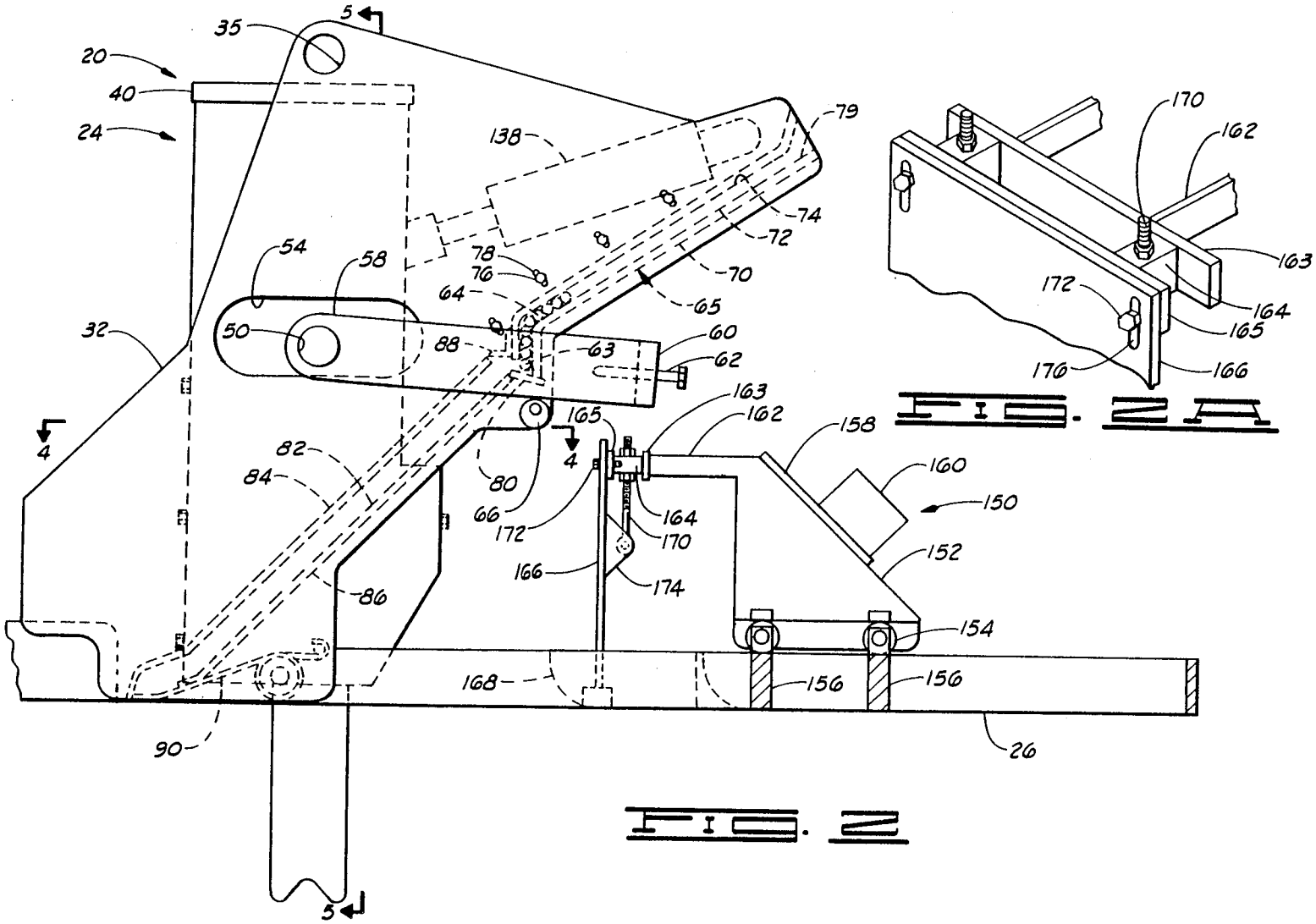
FIG. 2 is cross-sectional view taken along lines 2—2 of FIG. 1 illustrating some internal structure in phantom.

Referring to the drawings in detail, and particularly to FIGS. 1–3, the present invention comprises a center bar inserter designated generally by the reference numeral 20. The center bar inserter 20 is provided with a frame 22 for pivotally supporting a cage 24 above the concrete slab (not shown). A float pan 26, having an opening 28, sized for receiving a portion of the frame 22. The float pan 26 is secured to the profile pan (not shown) of a paving machine (not shown).

The frame 22 is formed by a first side plate 30 and a second side plate 32 and a bar 33. The bar 33 connects the forward lower ends plates 30 and 32 and secures the frame 22 to the profile pan (not shown) of the paving machine (not shown). The second side plate 32 is slidably secured along a portion of the bar 33 by a bracket 34 such that the spacing between the side plates 30 and 32 may be selectively varies. In this way, center bars of different lengths may be positioned between the side plates 30 and 32 for insertion into the concrete slab.

A rod 35, secured to the upper end of the first side plate 30, extends through an aperture in the upper end of the second side plate 32. The cage 24 is pivotally supported to the rod 35 between the first and second side plates, 30 and 32, by a pair of spaced bearings 36 and 38. The bearings, 36 and 38 are secured, as by welding, to a plate 40. A pair of U-shaped brackets, 42 and 44, each secured at the upper ends thereof to an end of the plate 40, extend substantially the length of the frame 20 (FIG. 2). The cage 24 is centered between the first and second side plates, 30 and 32, by spacers 46 positioned between the bearings 36 and 38 and the respective side plates 30 and 32. It will be understood that as the side plate 32 is slidably positioned along the bar 33, the spacers 46 are according positioned such that the centered position of the cage 24 is maintained.

A pair of horizontal shafts, 48 and 50, are secured to and extend outward from the brackets, 42 and 44 respectively, at intermediate locations thereon. The shafts, 48 and 50, extend through slots 52 and 54 in the side walls 30 and 32. One end of each of the bars 56 and 58 is secured to the extending ends of shafts 48 and 50, respectfully. The bars 56 and 58 extend rearward from the shafts 48 and 50. A bar 60 extends between bars 56 and 58 and is secured to the free ends thereof. A plurality of forward extending pins 62 (FIG. 2) are adjustably secured along the length of the bar 60 for displacing a lowermost center bar 63 in a column of center bars 64 supported in a magazine 65.

As shown in FIGS. 2 and 3, a pair of guide shafts 66, each extending outward from a respective side plate 30 and 32, provide vertical support for bars 56 and 58. Each guide shaft 66 is secured by fastening a threaded bolt 67 through an aperture (not shown) in each side plate 30 and 32. The threaded bolt 67 is eccentrically secured along the longitudinal axis of each guide shaft 66. In this way, by rotating the guide shafts 66 about the longitudinal axis thereof, the impact point of the pins 62 against the center bar 63 may be varied.

As shown most clearly in FIG. 3, the magazine 65 is provided with a pair of adjustable guides 68 and 70. The guides 68 and 70 are secured to the facing surfaces of the first and second side plates 30 and 32 respectively. Each guide, 68 and 70, includes two side-by-side flat bars 72 and 74 (FIGS. 2 and 6). The bar 72 is secured, as by welding, to the respective side plate. The bar 74 is secured to the respective side plate by a plurality of bolts 76 extending through corresponding slots 78 in the side plates 30 and 32 (FIG. 2). In this way, the distance between the bars 72 and 74, which is usually slightly greater than the diameter of the center bar to be inserted, may be varied to accommodate center bars having different diameters.

The upper portion of bar 74 is bent to form a filling funnel 79. The lower end of bar 72 extends beyond the lower end of bar 74 and a web 80, extending forward and slightly upward from the lower end of bar 72 forms a pocket for supporting one end of the center bar 63. A channel 82, adjacent the lower end of each guide 68 and 70 and formed by a bars 84 and 86, receives the displaced center bar 63. Bars 84 and 86 are secured, as by welding, to the facing surfaces of the respective side plates 30 and 32.

With continued reference to FIGS. 2 and 6, an L-shaped bracket 88 is secured to the lower end of each bar 74 such that a portion of the each bracket extends over a portion of the upper end of the channel 82. In this way, the bracket 88 assists the transition of the center bar rom the magazine 65 to the channel 82. Once in the channel 82, the center bar 63 is directed to the lower, forward end of the inserter 20 where the center bar 63 is supported by a spring-loaded holder 90.

Figure 4:
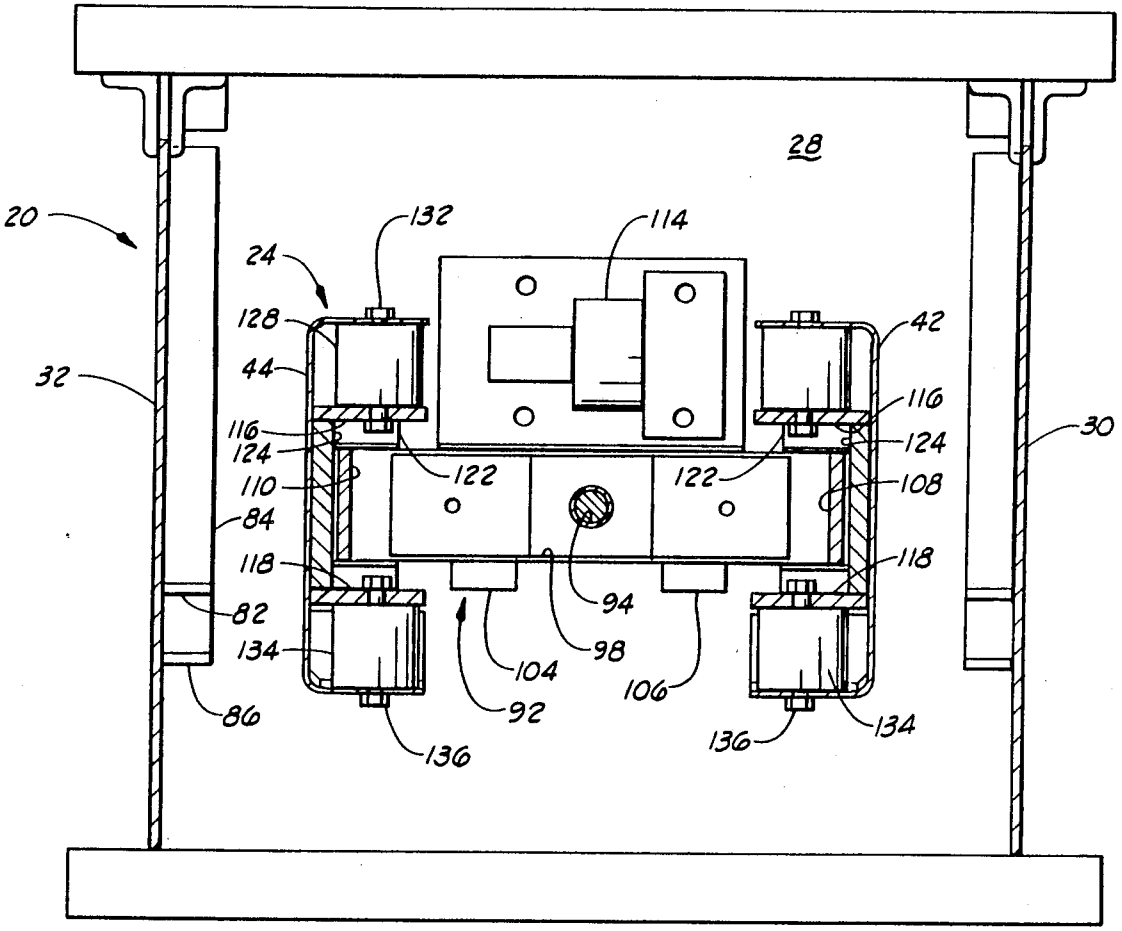
FIG. 4 is a cross-sectional view taken along but at a right angle to lines 4—4 of FIG. 2.
Figure 5:
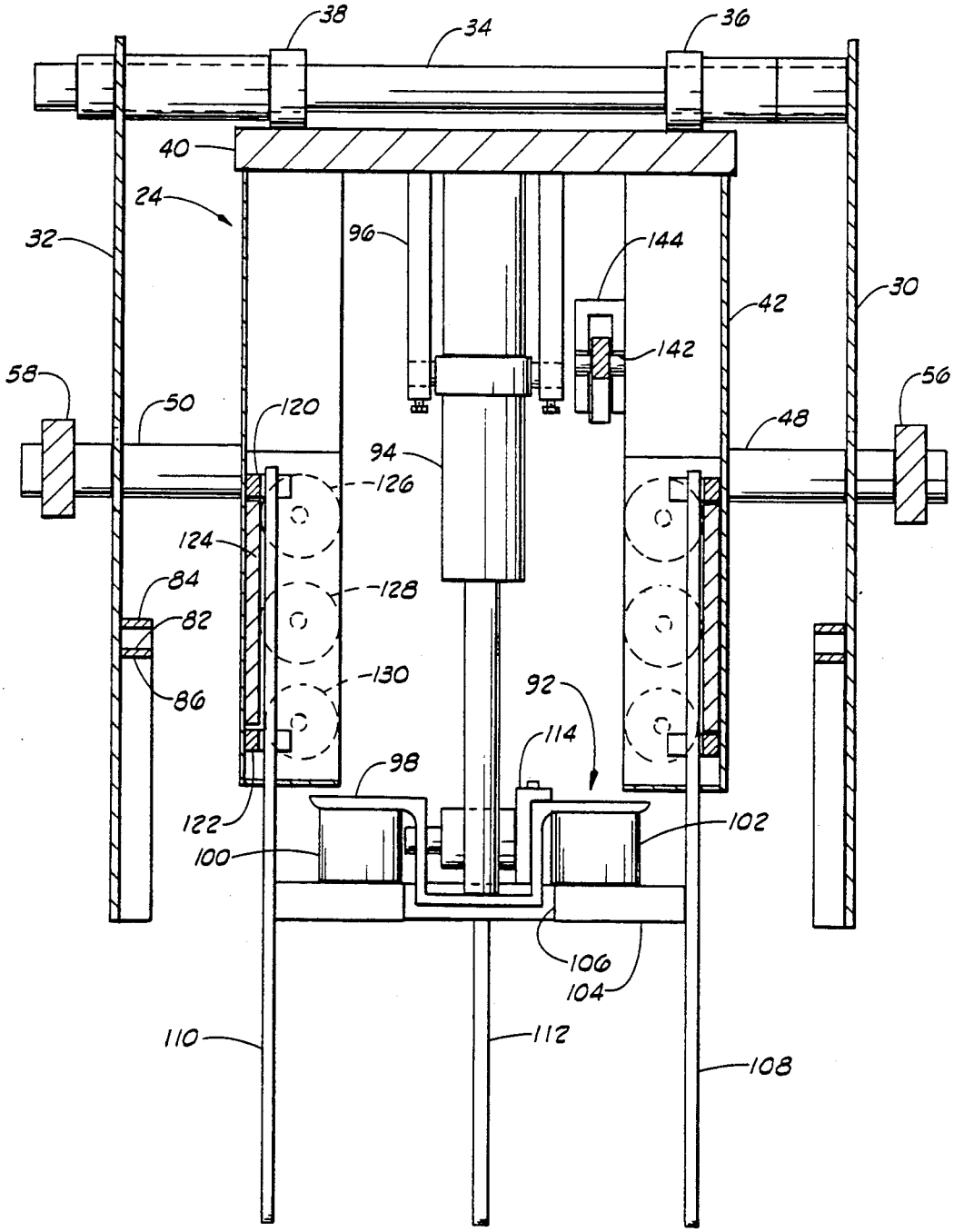
FIG. 5 is a cross-sectional view taken along lines 5—5 of FIG. 2.
Figure 5:
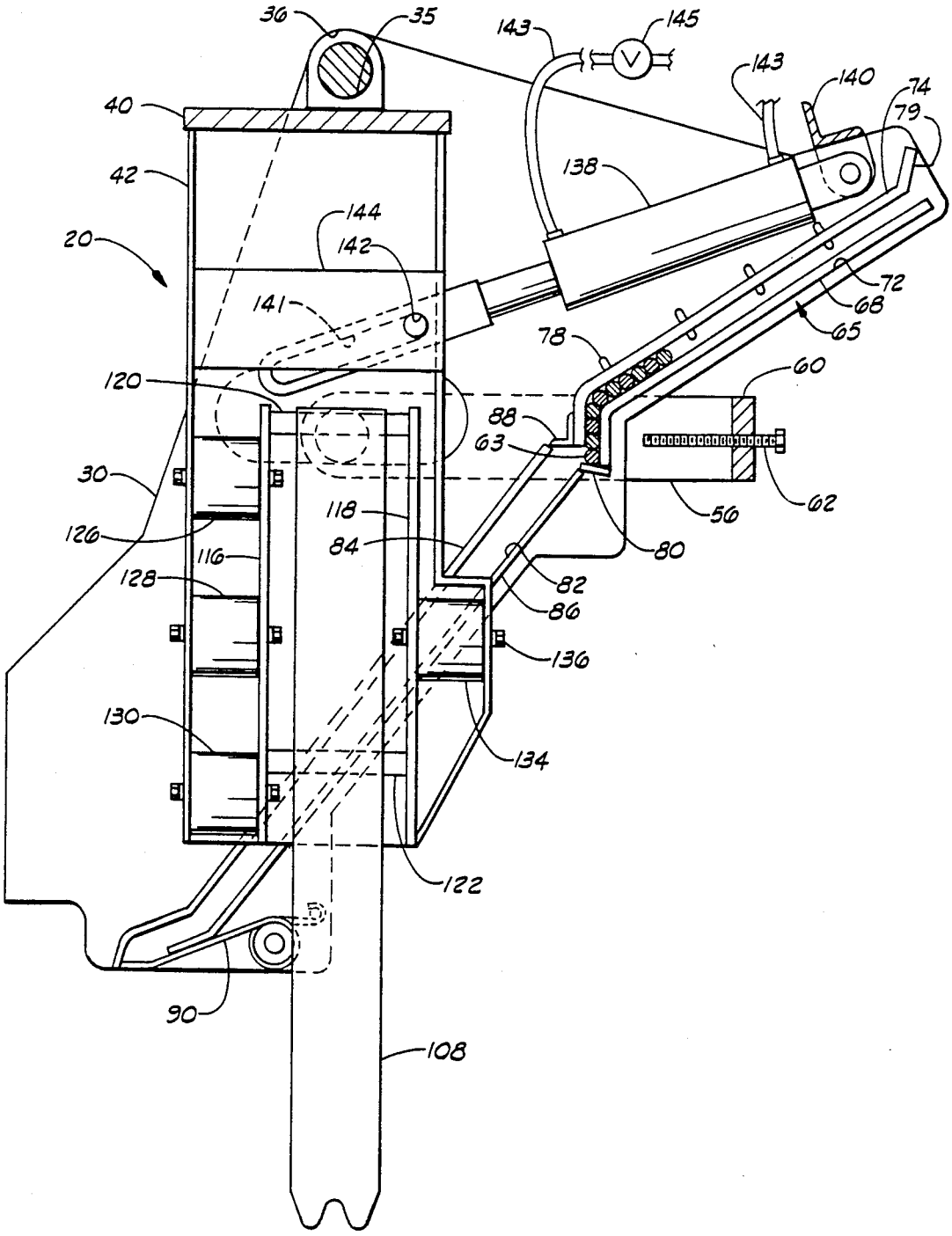

As shown in FIGS. 3–5, an inserter assembly 92 is supported between the U-shaped brackets 42 and 44 by a ram 94. The stationary end of the ram 94 is secured by a bracket assembly 96 to the underside of plate 40. The retractable end of the ram 94 is secured to a bracket 98. A pair of rubber vibration insulators 100 and 102 are secured between the bracket 98 and the upper surface of a horizontal vibration platform 104. The platform 104 has a slot 106 for loosely receiving a portion of the bracket 98.

Forks 108 and 110 are each secured at an intermediate portions thereof to an end of the platform 104 adjacent the respective brackets 42 and 44. A fork 112, equally spaced between forks 108 and 110, is secured at an end thereof to the platform 104. Each of the forks 108, 110 and 112 extends an equal distance below the platform 104. The end of each fork, 108, 110 and 112 extending beneath the platform 104 is notched for capturing a portion of the center bar 63. A vibrator 114 is secured to the platform 104 which imparts vibration to the forks 108, 110 and 112 during insertion and retraction thereof. Vibrating the forks 108, 110 and 112 minimizes the disturbance to the aggregate composition of the concrete slab.

As shown in FIGS. 4–6, each bracket, 42 and 44, is provided with a pair of parallel plates 116 and 118. The plates 116 and 118 are each secured, as by welding, to the interior of each U-shaped bracket 42 and 44. Each of the plates, 116 and 118, is of similar dimension and extends along the vertical length of the cage 24 from the lower end thereof to and intermediate location thereon. A pair of U-shaped fork guides, 120 and 122, are secured to the upper and lower portions, respectively, of each pair of plates 116 and 118. A plate 124 is secured to each bracket 42 and 44 between the guides 120 and 122 and the plates 116 and 118.

Three vertically spaced vibration insulators, 126, 128 and 130, are secured by bolts 132 between each plate 116 and the respective brackets 42 and 44. A single vibration insulator 134 is secured by bolts 136 between each plate 118 and the respective brackets 42 and 44. In this way, the cage 24 is substantially isolated from the vibrating forks 108, 110 and 112.

As shown in FIG. 6, a ram 138 is secured between a brace 140 and the bracket 42 for pivoting the cage 24 about the rod 35. The stationary end of the ram 138 is secured to the brace 140 and the retractable end of the ram 138 has a slot 141 for receiving a pin 142. The pin 142 is secured across an inverted U-shaped track 144, which is secured, as by welding, to the bracket 42. In this way, free play of the cage 24 about the rod 35 is limited to the length of the slot 141.

Hydraulic lines 143 convey hydraulic fluid under pressure to the ram 138 for powering the ram 138. An adjustable flow valve 145 is provided in one of the lines 143 for varying the flow of hydraulic fluid therein. In this way, the rate of collapse of the ram 138 may be controlled by the valve 145 such that the rearward pivotal speed of the cage 24 is synchronized with the forward speed of the paver. In this way, the forks 108, 110 and 112 enter and exit at substantially the same point in the concrete slab. It will be understood that depending upon the plasticity of the concrete, the valve 145 may be fully opened so that the cage 24 freely pivots about rod 35 without the forks 108, 110 and 112 substantially disturbing the concrete slab.

Figure 7:
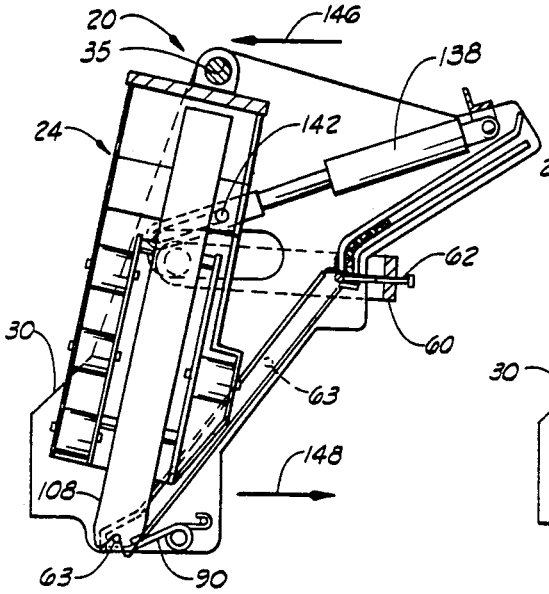
FIG. 7 is the same view as FIG. 6 illustrating portions of the center bar inserter in a pre-insertion position.
Figure 8:
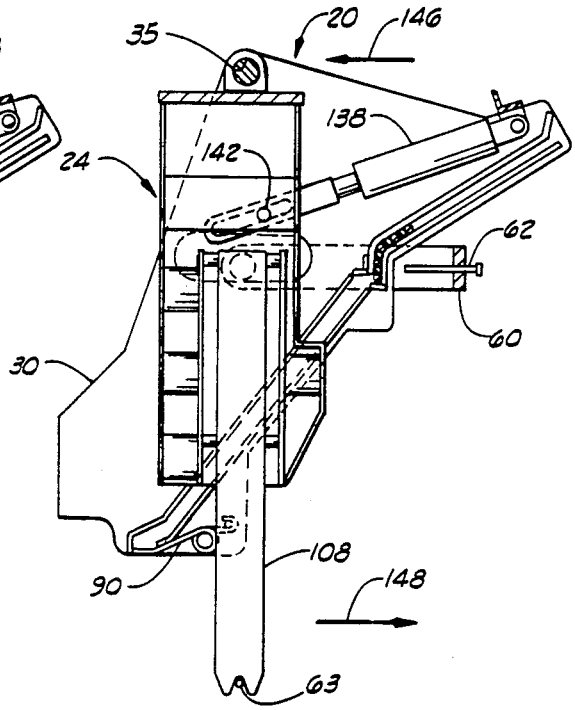
FIG. 8 is the same view as FIG. 6 illustrating portions of the center bar inserter in an extended position.
Figure 9:
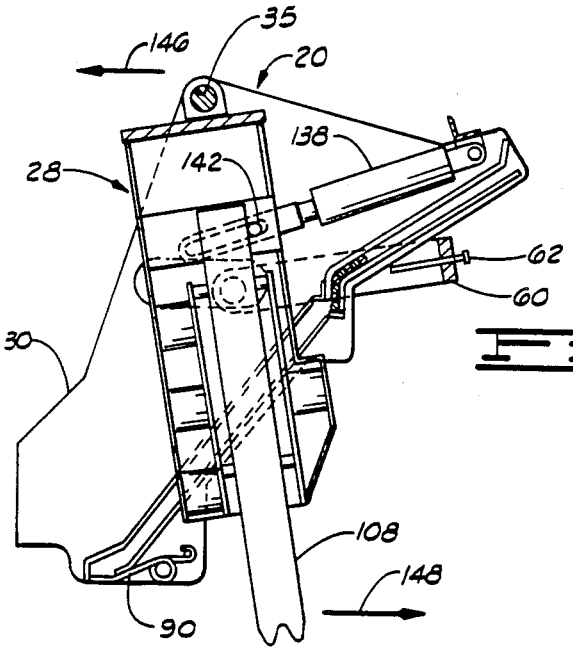
FIG. 9 is the same view as FIG. 6 illustrating portions of the center bar inserter in a retracted position.
Figure 10:
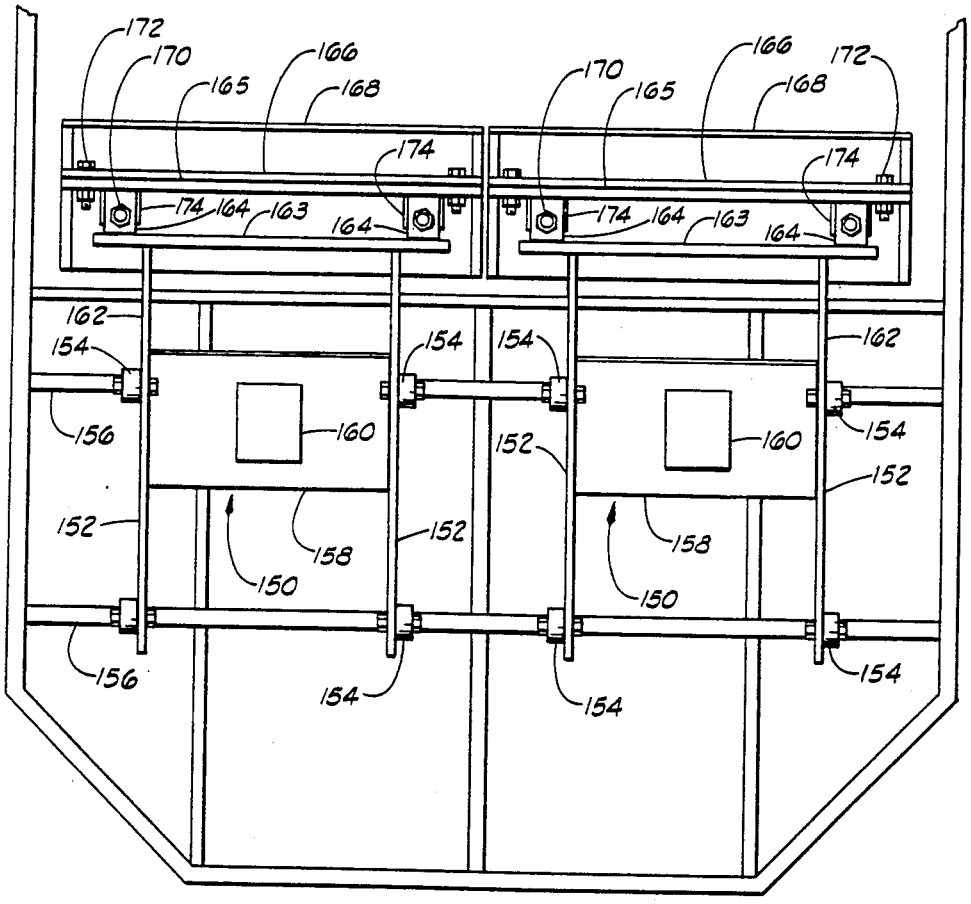
FIG. 10 is a top pan view of a pair of sleds secured to a float pan for use with the present invention.
Figure 11:
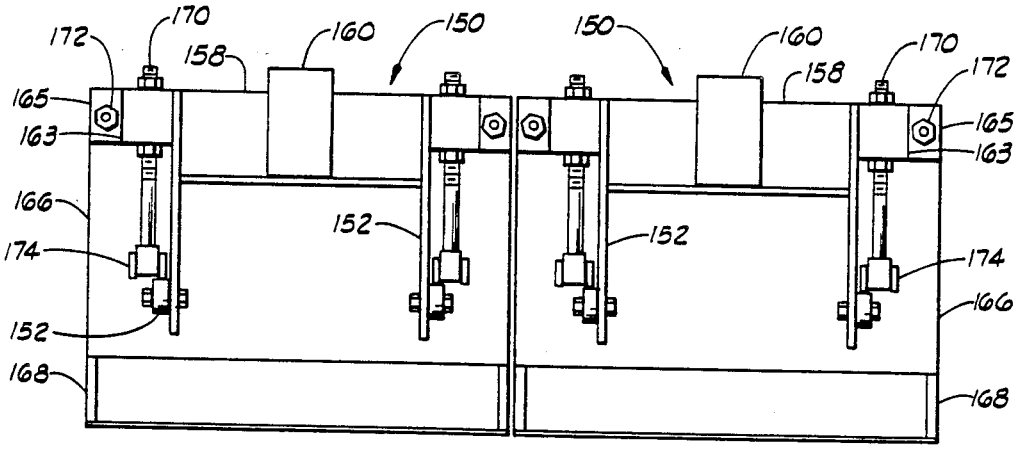
FIG. 11 is a rear elevational view of the sleds shown in FIG. 10 with the float pan removed for clarity of illustration.

The operating positions of the bar inserter 20 are illustrated in FIGS. 7–9. The bar inserter 20 is prepared for inserting the center bar 63 by raising the forks 108, 110 and 112 with the ram 96. The cage 24 is pivoted forward, towards a first position, in a direction 146 about the rod 35, hereinafter referred to as the horizontal axis of rotation, by extending ram 138. As the cage 24 pivots forward, the bar 60 is swung towards the magazine 65 such that the pins 62 contact and displace the center bar 63 from the column of center bars 64. The center bar 63 comes to rest in the spring holder 90 as described above.

In the first position, as shown in FIG. 7, the lower end of the cage extends forward of the horizontal axis of rotation such that the notched ends of the forks 108, 110 and 112 are above the center bar 63 supported by the holder 90. For ease of illustration, only the fork 108 is shown in FIGS. 7–9.

At a selected point along the concrete slab, the vibrator 114 is activated as the ram 94 extends the forks 108, 110 and 112. The extending forks capture the center bar 63 within the respective notches thereof such that the said bar is driven into the concrete slab. In concert with the insertion of the forks 108, 110 and 112, ram 138 relaxes allowing the cage 24 to pivot rearward in a direction 148. (FIG. 8). As a result of the motion of the paving machine in direction 146 and controlling the rate of pivotal motion of the cage 24 by the valve 145 in direction 148 in concert with extension of the ram 94, the point of insertion and retraction of the forks 108, 110 and 112 with respect to the concrete slab remains relatively constant. As the cage 24 pivots rearward in the direction 148, towards a second position, the ram 94 continues to drive the center bar 63 into the concrete slab by extending the forks 108, 110 and 112.

In the second position, as shown in FIG. 8, the forks 108, 110 and 112 are perpendicular to the concrete slab and extended therein to a selected depth. The cage 24 is also perpendicular to the surface of the slab such that the lower end thereof is beneath the horizontal axis of rotation. In will be understood that the insertion depth may be selectively varied by utilizing limit switches (not shown).

Upon reaching the terminal depth, the forks 108, 110 and 112 are retracted form the slab leaving the center bar 63 entombed within the concrete. As the forks 108, 110 and 112 are retracted, the continued forward motion of the paving machine may cause the cage 24 to pivot rearward of the horizontal axis as shown in FIG. 9. The insertion cycle is complete once the forks 108, 110 and 112 are retracted from the concrete slab, the vibrator 114 is turned off and the cage 24 centers beneath the rod 35.

Referring now to FIGS. 2, 2A, 10 and 11, the float pan 26 is provided with a pair of vibrating assemblies 150. Each vibrating assembly 150 is provided with a pair of plates 152. Each plate 152 is secured to the float pan 26 by a pair of insulators 154. The insulators 154 are secured to parallel cross braces 156 of the float pan 26. A plate 158, secured between respective plates 156 of each assembly 150, supports a vibrator 160 thereon. An arm 162 extends horizontally from the upper end of each plate 152 and a bar 163 is secured between each pair of respective arms 162. A pair of lugs 164 extend from respective ends of each bar 163. The extending ends of each pair of lugs 164 are secured to a bar 165.

A vertical plate 166, having a sled 168 secured to the lower end thereof, is secured to each bar 165 by plurality of bolts 170 and 172. Each bolt 170 extends through the respective lug 164 and is secured below the bar 165 to a bracket 174, which is secured to the plate 166. Each bolt 172 extends into a slot 176 in the plate 166 (FIG. 2A) and through the bar 165. In this way, the height of the sled 168 may be vertically adjusted by first loosing bolts 172 and varying the vertical position of each bolt 170 within the respective lug 164. After the selected position of the each sled 168 is obtained, the bolts 172 are snugly secured between the plate 166 and the bar 165.

In operation, the vibrators 160 are activated during the center bar insertion cycle described above. As the concrete slab is substantially formed prior to the insertion of the center bar, the vibration intensity and vertical adjustments to the sleds 168 of the sled assemblies 150 are set such that any surface disturbance caused by inserting the center bars is repaired. In this way, the surface of the slab is repaired without disturbing the position of the entombed center bar within the concrete slab.

Changes may be made in the construction, operation, and arrangement of the various parts, elements, and procedures described herein without departing from the spirit and scope of the invention as defined in the following claims.

What is claimed is:

1. An apparatus for inserting a bar into a concrete slab comprising:

a frame having an upper end, a lower end, a first side and a second side;

means for supporting the frame above the concrete slab;

a cage having an upper end and a lower end, wherein the cage is pivotally mounted about a horizontal axis thereof to the frame for rotation between a first position and a second position;

means for inserting the bar into the concrete slab, wherein the means is slidably secured within the cage for selective movement between a retracted position and an extended position; and means for supporting at least one bar above the concrete slab adjacent the means for insertion such that when the means for insertion is moved from the retracted position to the extended position in concert with the movement of the cage between the first position and the second position, the bar is driven to a selected depth within the concrete slab by the means for inserting.

2. The apparatus of claim 1 further including means for pivoting the cage between the first position and the second position.

3. The apparatus of claim 1 wherein the lower end of the cage extends forward of the horizontal axis when the cage is in the first position.

4. The apparatus of claim 3 wherein the means for insertion is in the retracted position when the lower end of the cage is in the first position, and wherein the means for insertion is in the extended position when the lower end of the cage is perpendicular to the concrete slab.

5. The apparatus of claim 1 wherein the upper end of the cage is pivotally secured to the upper end of the frame between the first and second sides thereof.

6. The apparatus of claim 1 further including means for varying the spacing between the first and second sides of the frame.

7. The apparatus of claim 6 wherein the means for varying the spacing includes a plurality of spacers removable secured between the first and second sides of the frame adjacent the upper end thereof.

8. The apparatus of claim 1 wherein the means for inserting includes a plurality of vertical forks having a first end and a second end, and wherein the first end of each fork is secured to a plate, and the second end of each fork has a notch therein for overlying a portion of the bar, and wherein a ram is secured between the horizontal plate and the upper end of the cage for extending and retracting the forks.

9. The apparatus of claim 1 further including a vibrator secured to the means for inserting and a plurality of insulators secured between the means for inserting and the cage.

10. The apparatus of claim 1 further including means for automatically positioning at least one bar in the means for supporting.

11. The apparatus of claim 10 wherein the means for automatically positioning includes a magazine secured between the first and second sides of the frame for supporting a column of bars and a pin secured to the pivoting cage for contacting the lower most bar in the magazine such that said bar is displaced from the column of bars, said displaced bar being ultimately supported by the means for supporting.

12. The apparatus of claim 1 further including means for repairing the surface of the concrete slab.

13. The apparatus of claim 12 wherein the means for repairing the surface of the concrete slab includes a vibrating sled secured rearward of the means for inserting and a means for adjusting the height of the vibrating sled in relation to the concrete slab.

14. The apparatus of claim 1 further including means for varying the pivotal speed of the cage from the first position to the second position.

* * * * *